United States Patent [19]

Ho

[11] 4,450,437

[45] May 22, 1984

[54] MOTION ALARM SYSTEM

[75] Inventor: Eugene Y. Ho, San Carlos, Calif.

[73] Assignee: Techne Electronics, Ltd., Palo Alto, Calif.

[21] Appl. No.: 281,957

[22] Filed: Jul. 10, 1981

[51] Int. Cl.[3] ..... G08B 21/00

[52] U.S. Cl. ..... 340/540; 340/573; 340/575

[58] Field of Search ..... 340/540, 573, 575

[56] References Cited

U.S. PATENT DOCUMENTS

| | | | |
|---|---|---|---|
| 3,802,417 | 4/1974 | Lang | 340/573 X |
| 3,982,238 | 9/1976 | Byers | 340/573 |
| 4,017,843 | 4/1977 | Yanagishima | 340/575 X |
| 4,110,741 | 8/1978 | Hubert et al. | 340/573 |
| 4,146,885 | 3/1979 | Lawson, Jr. | 340/573 X |
| 4,196,429 | 4/1980 | Davis | 340/573 X |
| 4,279,257 | 7/1981 | Hochstein | 340/573 X |
| 4,292,630 | 9/1981 | Dumont | 340/573 |

*Primary Examiner*—Glen R. Swann, III

*Attorney, Agent, or Firm*—Flehr, Hohbach, Test, Albritton & Herbert

[57] ABSTRACT

A motion alarm system including a motion detector which provides a motion signal. A signal level detector for detecting the motion signal and providing an output signal when the motion signal exceeds a selected level, and an alarm circuit providing an alarm if the motion signal does not exceed the selected level for a predetermined time.

6 Claims, 3 Drawing Figures

MOTION ALARM SYSTEM

BACKGROUND OF THE INVENTION

This invention relates generally to a motion alarm system and particularly to a motion alarm system which provides an alarm if a motion detector does not provide a motion signal for a predetermined time.

In U.S. Pat. No. 4,205,300 there is described a vehicle anti-theft alarm system. The system includes a plurality of position sensitive switches for sensing motion of the vehicle. Each of said switches has an individual initial state dependent upon the position of the supporting surface for the vehicle and is arranged to change its state from its initial state in response to motion. The switches are respectively either opened or closed in their initial state depending upon the orientation of the vehicle surface and position of the switch. Some of said switches being open in the initial state and others being closed in the initial state. Switches individually selectively change from the initial state in response to movement of the vehicle. Circuit means are responsive to said switches individually being selectively changed from the initial state in response to movement of the vehicle for operating an inhibiting or alarm circuit.

The system is particularly advantageous because it does not require specific orientation of the motion detector. The motion detector can be mounted at any orientation and it is only movement which serves to provide a signal when one or more of the plurality of switches changes its state. Mercury switches disposed at different orientations in a switch assembly are described in one embodiment of the patent.

In many applications it is desirable to provide an alarm when motion ceases rather than when motion commences. One example is in fire fighting. The fireman enters a building or an area to combat fire. If the fireman is overcome by smoke or struck by falling debris, it is desirable to provide an alarm so that fellow firemen can come to his rescue. A system which could provide such an alarm would save lives. Generally under such circumstances the fireman is motionless. An alarm system which provides an alarm after the fireman is motionless for a predetermined period of time would alert his fellow firemen who would then come to his rescue. Other applications would be to alarm persons or things working or operating in a dangerous environment.

OBJECTS AND SUMMARY OF THE INVENTION

It is, therefore, an object of the present invention to provide a system which provides an alarm if there is no motion of an alarmed object or person for a predetermined period of time.

It is another object of the present invention to provide an alarm system in which an alarm is sounded if a motion detector does not provide an output signal for a predetermined period of time.

It is a further object of the present invention to provide an alarm system for sounding an alarm if a fireman or the like is motionless for a predetermined period of time after entering into a dangerous area.

The foregoing and other objects of the invention are achieved by a system which includes a motion detecting means providing an output signal when there is motion and means connected to receive said output signals and provide an alarm if no motion signal is received for a predetermined period of time.

DESCRIPTION OF THE PREFERRED EMBODIMENT

Figure 1:
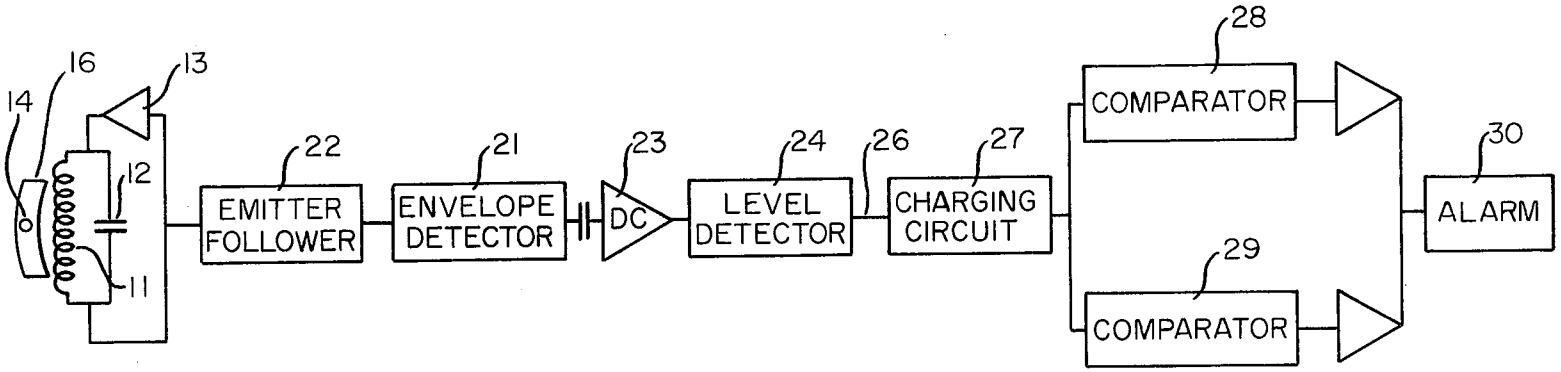
FIG. 1 is a block diagram of a motion alarm system in accordance with the present invention.

Referring to FIG. 1 the motion sensing portion of the system is seen to include a tuned circuit comprising an inductance 11 and a capacitance 12. An amplifier 13 is connected to the tuned circuit to supply power to cause the circuit to oscillate at a predetermined frequency dependent upon the values of the inductance and capacitance. The amplifier circuit, as will be presently described, is a current limited amplifier circuit so that it operates as a current source to supply substantially constant power to the oscillator circuit so that the circuit normally operates at a predetermined amplitude.

A mercury drop 14 disposed in a glass tube 16 is mounted along the axis of the coil forming the inductor 11. Motion of the tube will cause the mercury drop to move along the tube in and out of the center of the coil where the magnetic field is the strongest. This action introduces variable losses in the tuned circuit and changes the amplitude of the voltages across the tuned circuit. It is clear that other movable elements may be used in place of the mercury drop. For example, a metal slug mounted on weak springs could be used. Any motion sensitive member which introduces losses to the tuned circuit will suffice.

Figure 2:
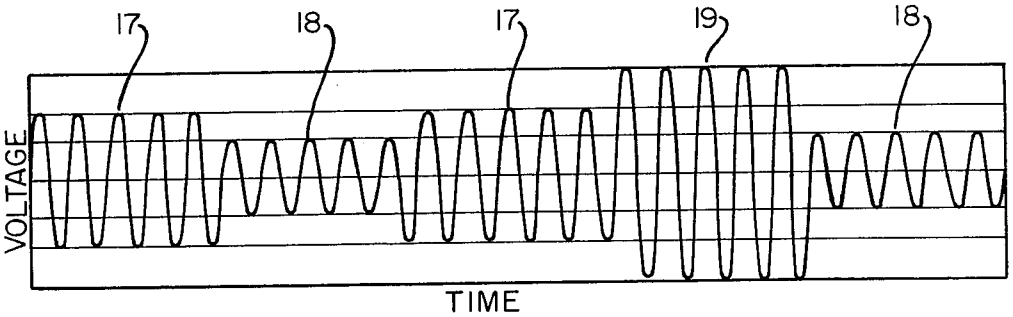
FIG. 2 shows typical signals on the tuned circuit shown in FIG. 1.

The operation of this circuit is illustrated in FIG. 2. The normal oscillating amplitude is shown at 17, the oscillations 18 indicate a positioning of the mercury drop to introduce heavy losses and therefore decrease the amplitude of oscillations whereas oscillations 19 show an increase in amplitude which occurs when the mercury drop is at its extreme position. Thus, during normal quiescent operation the oscillations will have one value such as value 17 while with motion the mercury drop will move along the tube 16 and provide both decreased amplitude oscillations such as shown at 18 and increase amplitude oscillations such as shown at 19.

An envelope detector, in the form of an emitter follower is connected to the oscillator so that the envelope detector does not load the tuned circuit. The envelope detector receives the amplitude modulated oscillation and provides a varying direct current (DC) output signal and is capacitively coupled to the DC amplifier 23. The output of the amplifier 23 is a variable voltage which corresponds to the motion of the mercury drop. The varying output voltage from the amplifier 23 is supplied to a level detector 24 which can comprise a pair of comparators set to high and low limits to accommodate for the swing of the output voltage of the amplifier as indicated by the regions 18 and 19 of FIG. 2. When the voltage is outside of this window the circuit considers that motion has occurred and will provide an output signal on the line 26.

The output from the level detector is applied to a charging circuit 27 which is charged by the output signal on line 26. The charging circuit is connected to comparators 28 and 29. Comparator 28 provides an output warning voltage to the alarm 30. This is at reduced voltage and serves only as a warning. When there is no voltage for a predetermined time the comparator 29 provides an output signal which activates the alarm 30 to sound an alarm.

Figure 3:
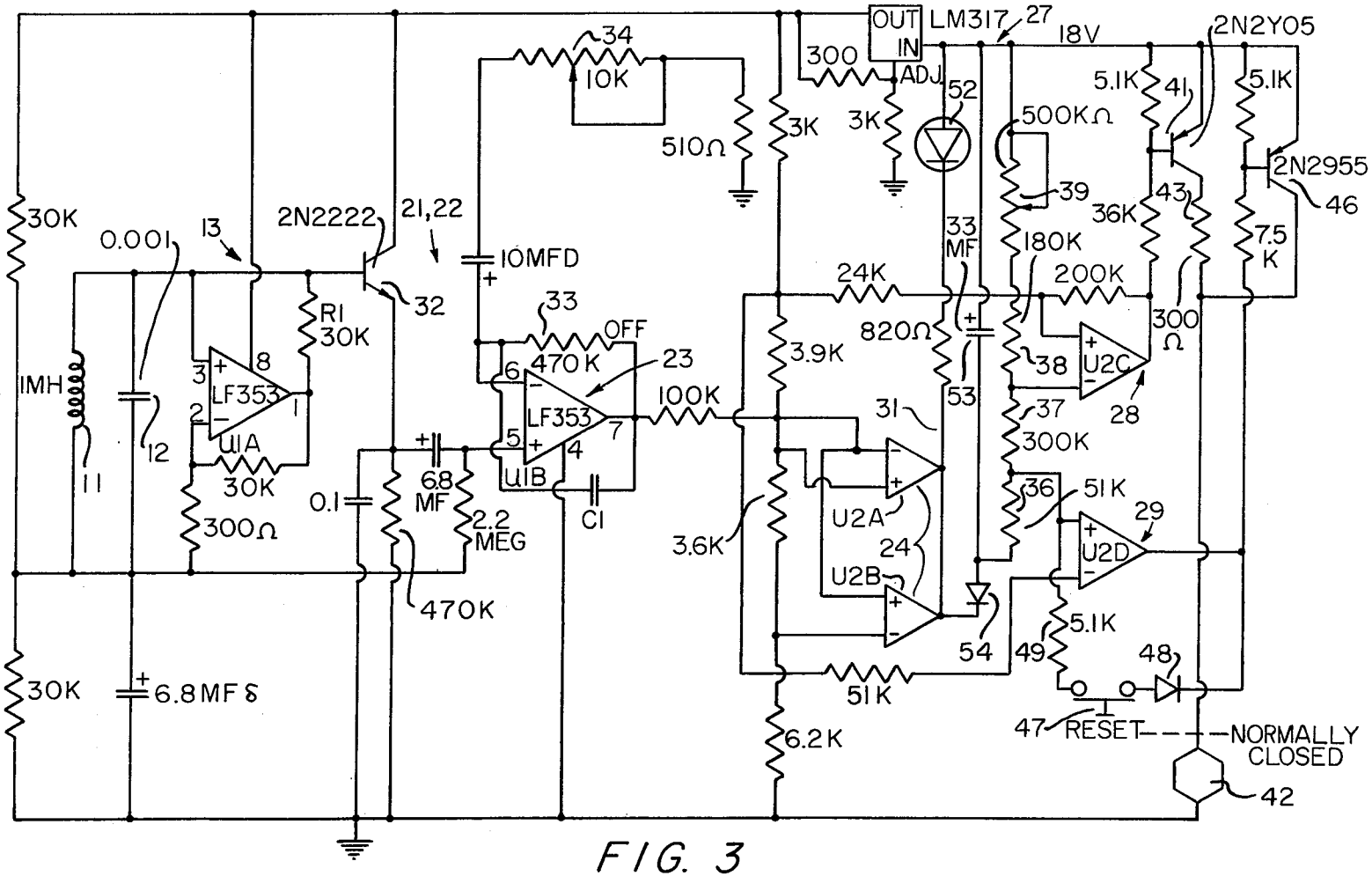
FIG. 3 is a detailed circuit diagram of the system shown in FIG. 1.

FIG. 3 is a detail circuit diagram of one embodiment of the present invention. The component values used in the system are shown on the drawing, FIG. 3. The amplifiers U1A, U1B are LF353 dual operational amplifiers and U2A, U2B, U2C and U2D and LM 393 comparators.

Operational amplifier U1A and associated components form amplifier 13 for driving the tuned circuit comprising the inductor 11 and capacitor 12. The output from the operational amplifier is shown fed to the tuned circuit through resistor R1 to sustain oscillations. The resistor R1 is selected to make the amplifier look like a current source. The voltage across the coil, being fed by the current source decreases as the mercury drop moves closer to the center of the coil where the losses of the tuned circuit are at maximum as illustrated at 18, FIG. 2. Although the oscillating frequency of the circuit is not critical in this example, it was selected to be about 160 KHz for the convenience of using reasonable sized components in the associated circuits. The amplifier U1A operates at its maximum output to provide constant drive to the circuit.

The transistor 32 is connected as an emitter follower to reduce loading of the tuned circuit and also acts as the envelope detector which provides an output signal having an amplitude corresponding to the envelope of the oscillator signal, FIG. 2, to the DC amplifier 23 including U1B and associated components. The output of this amplifier is a slowly varying DC voltage about 100 times larger than the output of the envelope detector. The capacitor C1 and resistor 33 provide a feedback circuit for the amplifier 23 so that it does not respond to detector ripple or other interference which might be picked up by the high impedance of the envelope detector. The gain of the amplifier can be adjusted with potentiometer 34.

The output from the amplifier 23 is applied to the level detector 24. The level detector comprises dual comparators U2A and U2B connected as a window detector. In the present example when the voltage output goes below 3.64 V or above 7.04 V the output comparators are driven to ground potential. In such condition the output line 31 is grounded.

A light emitting diode 52 is turned on indicating that there is motion in that the detector output has exceeded its predetermined upper or lower limits.

The outputs on the comparators U2A and U2B are driven toward ground voltage by the excessive voltage swing at the output of the amplifier U1B, which discharges a capacitor 53 towards ground voltage through diode 54. After the output of the amplifier returns to normal, the outputs of comparators U2A and U2B will return to 18 volts and the diode 54 becomes non-conducting. The capacitor 53 then discharges towards 18 volts through the resistors 36, 37, 38 and 39. As the voltage on the capacitor approaches 18 volts it will pass the triggering point of comparator U2C. The output of this comparator will turn on the transistor 41. This transistor supplies current for a warning tone by driving the audio alarm 42 at a reduced output volume through a resistor 43 connected in series with its collector. This process will repeat itself. When there is successive motion on the mercury drop and the capacitor 53 is charged towards ground potential, the warning tone driver will be turned off.

However, if there is no excessive motion for a predetermined length of time then the capacitor 53 will discharge slowly towards 18 V, turning on the transistor 41 and provide the initial warning tone by driving the alarm 42. As the voltage continues to rise through the resistive network a second comparator U2D is turned on. Its output will drive transistor 46 into full conduction to supply electrical current directly to the audio alarm 42 for full volume output. This will continue until reset button 47 is pressed to cancel the alarm. That is, the transistor is locked into conduction until it is disarmed via the switch 47. This locking action is achieved by feeding back the output voltage of U2D through diode 48 and resistor 49 and closed switch 47 to the positive input lead of the comparator.

An alarm was constructed in accordance with the drawing with the values shown and operated in accordance with the foregoing description. The alarm provided output warning signals when there was no motion for 20 seconds.

Thus it is seen that there has been provided a simple motion alarm which provides an output when there is a lack of motion.

What is claimed:

1. A system for providing an alarm when motion is not sensed comprising a motion detecting means for providing a motion signal whose amplitude varies with motion a level detector connected to receive said output motion signal and provide an output signal when the amplitude of said motion signal is greater than a first amplitude or less than a second amplitude means for receiving the level detector output signal and generating a voltage whose amplitude decreases in the absence of a level detector output signal and means responsive to said voltage for providing an alarm signal when the voltage decreases to a predetermined level due to the absence of a level detector output signal for a predetermined time.

2. A system as in claim 1 in which said means responsive to said voltage for providing an alarm provides a warning signal when the voltage reaches a first level and after a predetermined time when the voltage reaches a second level.

3. A system as in claim 2 in which said means responsive to said voltage for providing said warning signal and said alarm signal comprise first and second voltage comparators respectively.

4. A system for providing an alarm when motion is not sensed comprising a motion detecting means for providing a motion signal whose amplitude varies with motion a level detector connected to receive said motion signal and provide an output signal when the amplitude of said motion signal is greater than a first amplitude or less than a second amplitude.

a charging circuit adapted to control the charge on a capacitor responsive to the level detector output signal whereby to control the voltage across said capacitor first means connected to sense the voltage across said capacitor and provide a warning signal when the voltage attains a first voltage level and second means connected to sense the voltage across said capacitor and provide an alarm signal when the voltage attains a second voltage level.

5. A system as in claim 4 in which said motion detecting means comprises an oscillator circuit which provides an output oscillator signal whose amplitude varies with motion and an envelope detector for receiving the output oscillator signal and provide the motion signal.

6. A system as in claim 5 in which said first and second means connected to sense the voltage on the capacitor are voltage comparators.

* * * * *